US006906670B2

(12) United States Patent
Shi

(10) Patent No.: US 6,906,670 B2
(45) Date of Patent: Jun. 14, 2005

(54) CARD DEVICE HAVING ANTENNA OF TWO OR MORE DIFFERENT FREQUENCIES

(75) Inventor: Eric Shi, Hsin Chuang (TW)

(73) Assignee: Global Sun Technology, Inc., Taichung (TW)

( * ) Notice: Subject to any disclaimer, the term of this patent is extended or adjusted under 35 U.S.C. 154(b) by 77 days.

(21) Appl. No.: 10/440,798

(22) Filed: May 16, 2003

(65) Prior Publication Data

US 2004/0227671 A1 Nov. 18, 2004

(51) Int. Cl.[7] ..... H01Q 1/24
(52) U.S. Cl. ..... 343/702; 343/873
(58) Field of Search ..... 343/702, 700 MS, 343/873, 906; H01Q 1/24

(56) References Cited

U.S. PATENT DOCUMENTS 6,762,724 B2 * 7/2004 Peng ..... 343/702
2002/0175866 A1 * 11/2002 Gram ..... 343/702
2004/0036654 A1 * 2/2004 Hsieh ..... 343/702
2004/0090373 A1 * 5/2004 Faraone et al. ..... 343/700 MS
2004/0104850 A1 * 6/2004 Otaka et al. ..... 343/700 MS

* cited by examiner

*Primary Examiner*—Hoanganh Le
(74) *Attorney, Agent, or Firm*—Charles E. Baxley

(57) ABSTRACT

A wireless card device includes a board member, a processor device attached to the board member, a wireless control device attached to the board member, and coupled to the processor device, and an antenna device disposed on the board member and coupled to the wireless control device. The antenna device includes one extension to receive and transmit signals of a frequency, and another extension to receive and transmit signals of a different frequency. The antenna device may include the extensions extended from the sides of a base member, and may include a conductor arranged around the base member and the extensions.

1 Claim, 5 Drawing Sheets

Location: RF Chamber 1 Date: 2003/1/3 Time: PM 04:46:41

Temperatuer (℃): 20 Humidity (%): 65 Approved by:

Frequency (MHz): 5750.00 Antenna Polarity: Horizontal Average Gain (dB): 0.66

Maximum Gain (dB): 8.11 Maximum Gain (degree): 184

Minimum Gain (dB): -13.45 Minimum Gain (degree): 48

Location: RF Chamber 1 Date: 2003/1/3 Time: PM 04:40:51

Temperatuer (℃): 20 Humidity (%): 65 Approved by:

Frequency (MHz): 2450.00 Antenna Polarity: Horizontal Average Gain (dB): -1.56

Maximum Gain (dB): 1.90 Maximum Gain (degree): 192

Minimum Gain (dB): -21.11 Minimum Gain (degree): 164

CARD DEVICE HAVING ANTENNA OF TWO OR MORE DIFFERENT FREQUENCIES

BACKGROUND OF THE INVENTION

1. Field of the Invention

The present invention relates to a wireless card device, and more particularly to a wireless card device having an antenna device for receiving and transmitting signals of two or more different frequencies.

2. Description of the Prior Art

Various kinds of network systems have become more and more popular nowadays. Heretofore, the computers of the end users are required to be coupled to or communicated with the network systems with or via cable connections. However, the cable connected network systems are inconvenient for both the end users and the network system providers.

Recently, wireless network systems have become more and more popular, and have mostly substituted the cable connected network systems. For entering into or for communicating with the wireless network systems, various kinds of wireless card devices are required to be prepared and coupled to the computers of the end users, and include an antenna device for communicating with the wireless network systems.

However, the typical wireless card devices for the typical wireless network systems normally comprise a single antenna device that may receive and transmit signals of a particular or predetermined frequency only.

However, a number of different frequencies have been provided and used for the typical wireless network systems. For example, at least 802.11a and 802.11b of the institute of electrical and electronic engineers (IEEE), i.e., at least two different frequencies: IEEE 802.11a and IEEE 802.11b have been provided and used for the typical wireless network systems.

For communicating with the wireless network systems of different frequencies, the end users have to purchase and prepare two or more kinds of wireless card devices each of which includes an antenna device that may receive and transmit signals of a particular or predetermined frequency only.

The present invention has arisen to mitigate and/or obviate the afore-described disadvantages of the conventional wireless card devices.

SUMMARY OF THE INVENTION

The primary objective of the present invention is to provide a wireless card device including an antenna device for receiving and transmitting signals of two or more different frequencies.

In accordance with one aspect of the invention, there is provided a wireless card device comprising a board member, a processor device attached to the board member, a wireless control device attached to the board member, and coupled to the processor device, and an antenna device provided on the board member, and coupled to the wireless control device. The antenna device includes a first extension extended therefrom to receive and transmit signals of a frequency, and a second extension extended therefrom to receive and transmit signals of a frequency different from that of the first extension. The antenna device may thus be provided to receive and transmit signals of two or more different frequencies simultaneously.

The antenna device includes an intermediate portion having a base member provided therein. The base member of the antenna device preferably includes a side portion having the first extension extended therefrom. The first extension preferably includes an L-shaped configuration.

The base member of the antenna device includes a side portion having the second extension extended therefrom. The second extension preferably includes an L-shaped configuration.

The antenna device preferably includes a conductor provided around the base member and the first extension and the second extension of the antenna device, to form a hollow space in the antenna device. The antenna device includes a terminal coupled to the wireless control device.

Further objectives and advantages of the present invention will become apparent from a careful reading of the detailed description provided hereinbelow, with appropriate reference to the accompanying drawings.

DETAILED DESCRIPTION OF THE PREFERRED EMBODIMENT

Figure 1:
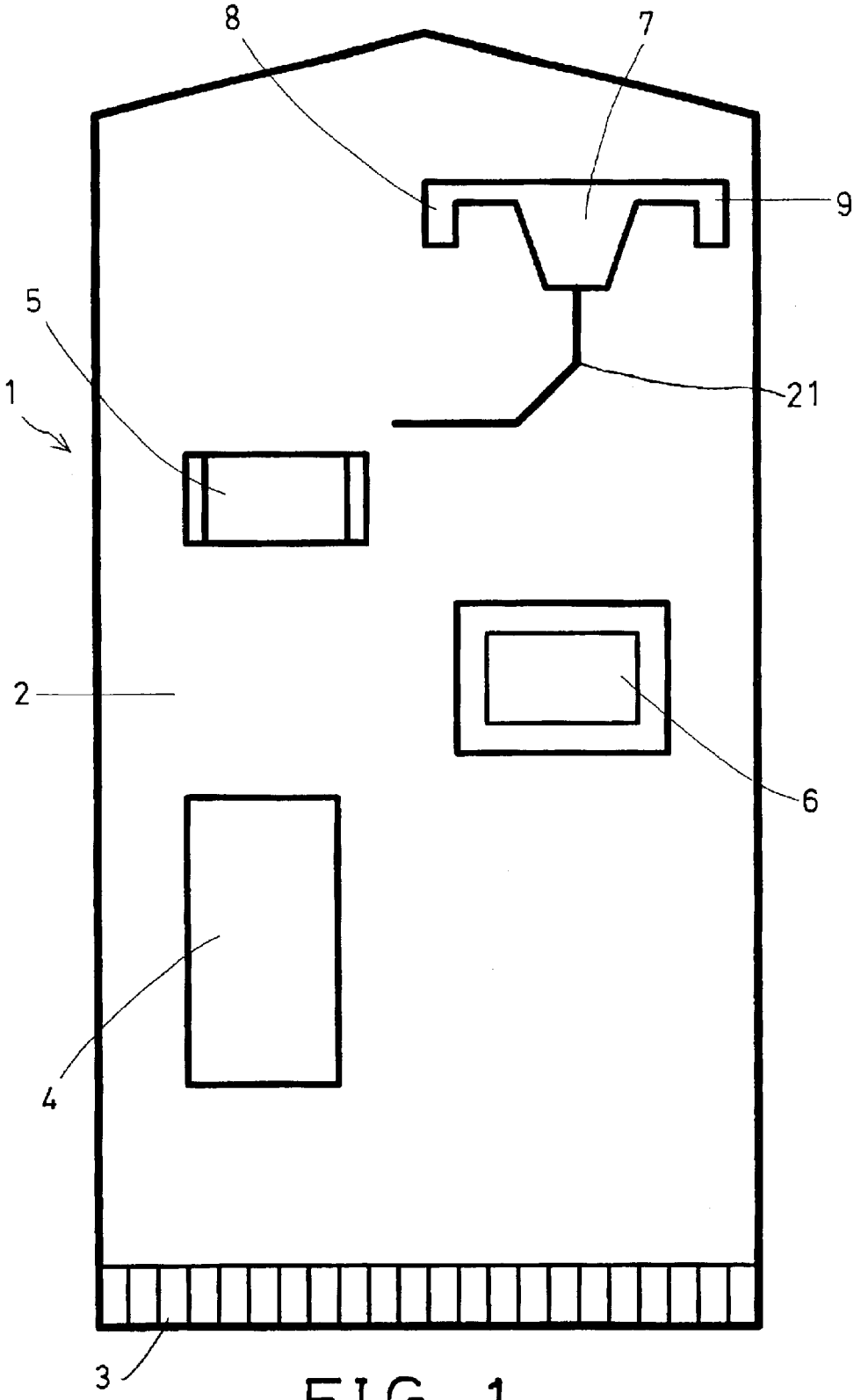
FIG. 1 is a plan schematic view of a wireless card device in accordance with the present invention.
Figure 2:
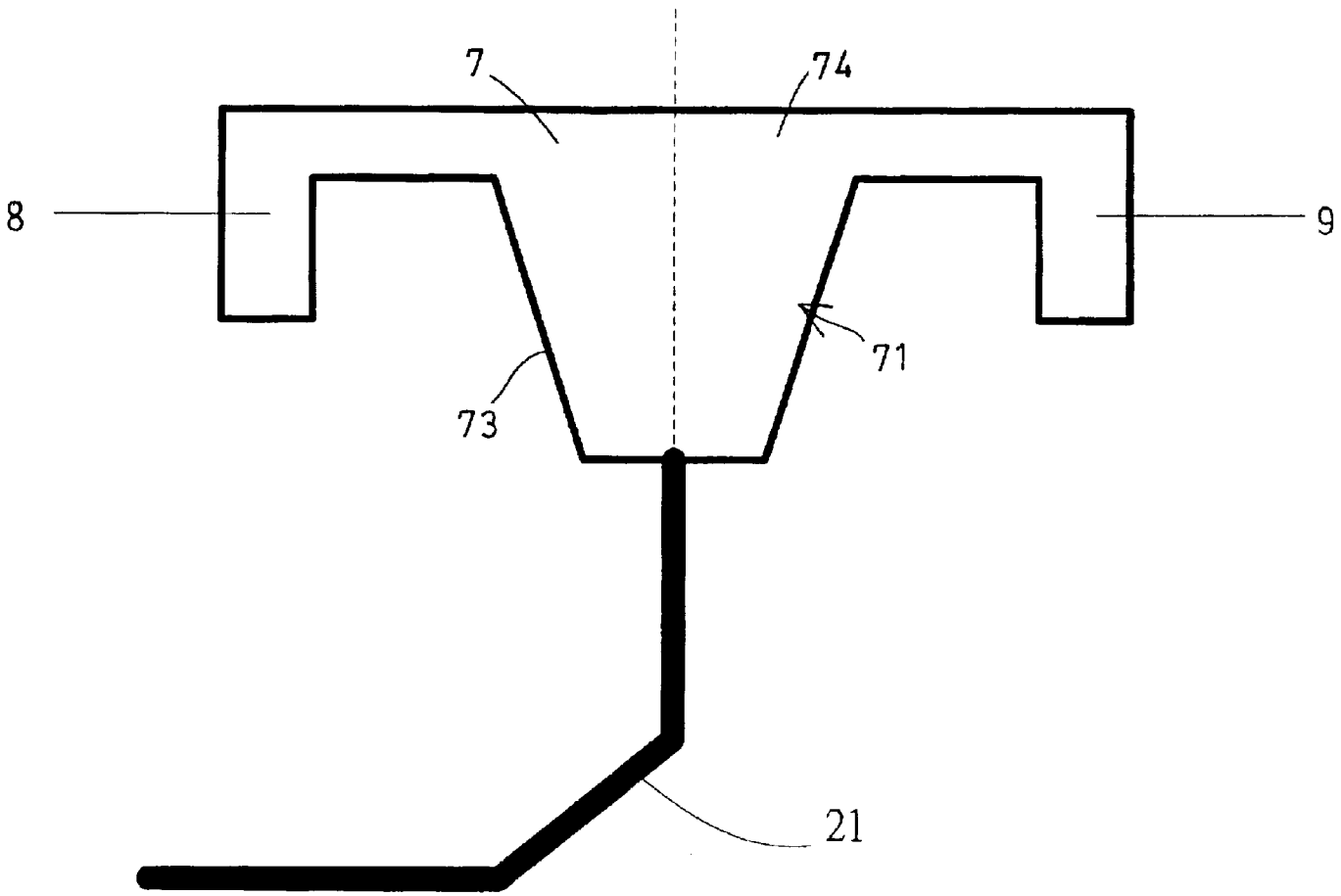
FIG. 2 is an enlarged plan schematic view illustrating an antenna device for the wireless card device.

Referring to the drawings, and initially to FIGS. 1 and 2, a wireless card device 1 in accordance with the present invention comprises an electric circuit board or card body or board member 2 including one edge 3 for plugging or coupling to the computers (not shown) of the end users.

The wireless card device 1 or the board member 2 includes a processor device 4, a wireless control circuit or device 5, and/or other circuits or devices 6 provided or attached thereon, and electrically connected together, for wirelessly communicating with the wireless network systems.

The wireless card device 1 or the board member 2 further includes an antenna device 7 provided or disposed thereon, and electrically coupled to the wireless control device 5 with a wire, cable, or conductor or terminal 21, or the like.

For example, the antenna device 7 and/or the terminal 21 may be provided or applied onto the board member 2 by such as a printed circuit manufacturing process, for allowing the antenna device 7 and the terminal 21 to be printed or applied onto the board member 2 without additional assembling processes.

The antenna device 7 includes a base member 71, such as a trapezoidal base member 71 provided in the intermediate portion thereof, an L-shaped extension 8 provided or extended from one side of the base member 71, and another L-shaped extension 9 provided or extended from the other side of the base member 71, such that the antenna device 7 includes a substantially lying-down E-shaped configuration.

As best shown in FIG. 2, it is preferable that the antenna device 7 includes a cable-like conductor 73 formed or provided around the lying-down E-shaped configuration of the antenna device 7, and coupled to the terminal 21 of the antenna device 7, in order to form or define a hollow space 74 in the antenna device 7.

Figure 3:
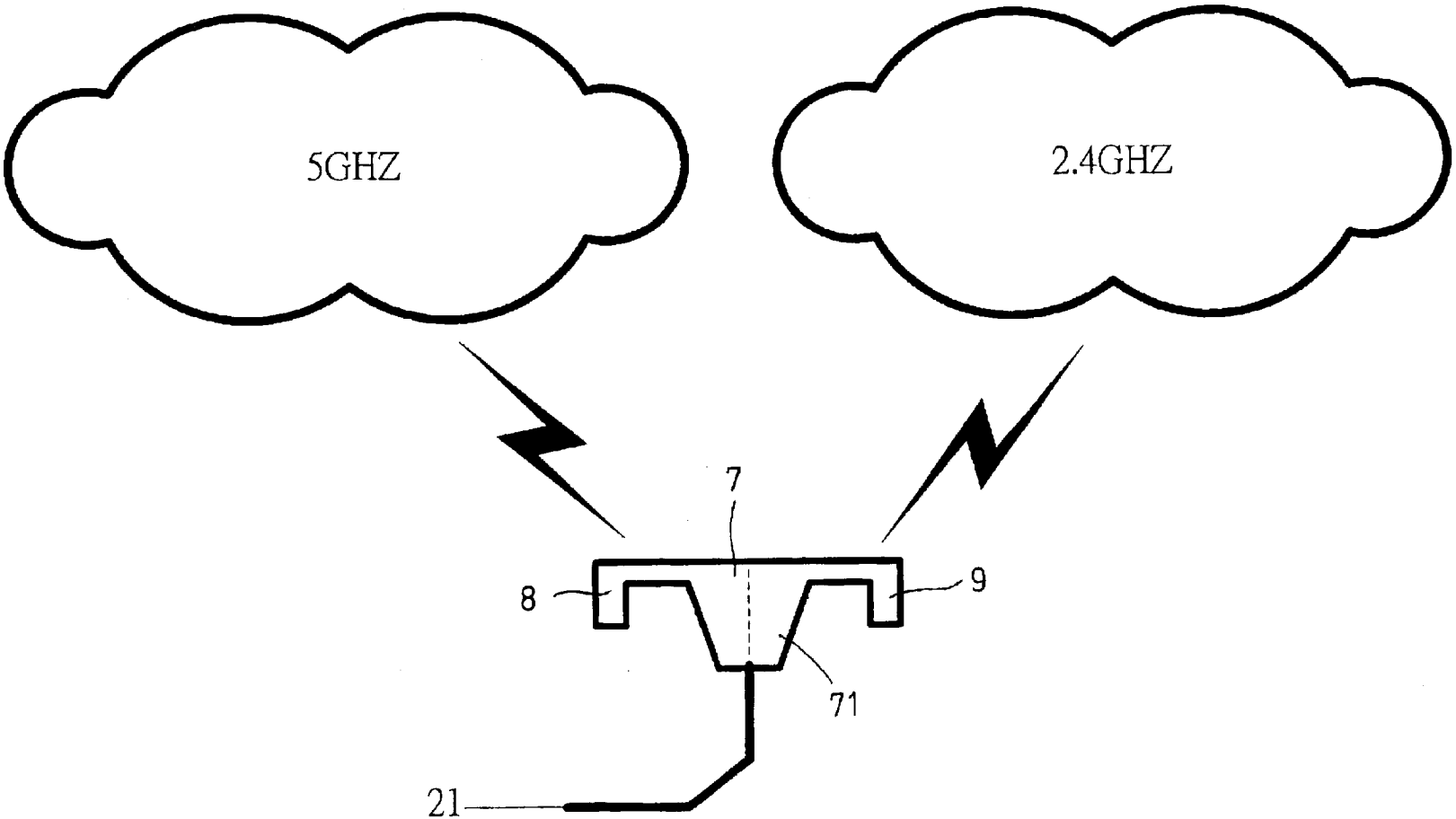
FIG. 3 is a plan schematic view illustrating the operation of the antenna device of the wireless card device.
Figure 4:
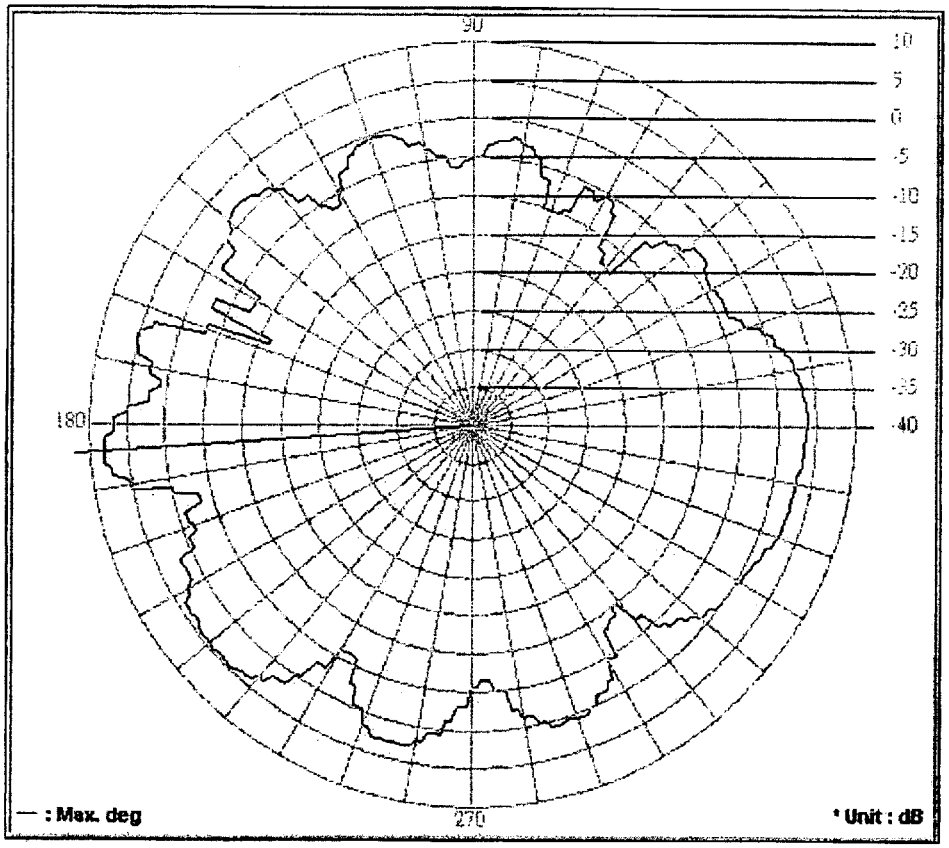
FIG. 4 is a diagram illustrating the higher frequencies of the antenna device of the wireless card device.

In operation, as shown in FIG. 3, the extension 8 of the antenna device 7 may be provided to receive and transmit the signals of one of the frequencies, such as the higher or greater frequency: IEEE 802.11a of such as 5 GHz. One example of the radiating field of the higher or greater frequency: IEEE 802.11a of such as 5 GHz is shown in FIG. 4.

Figure 5:
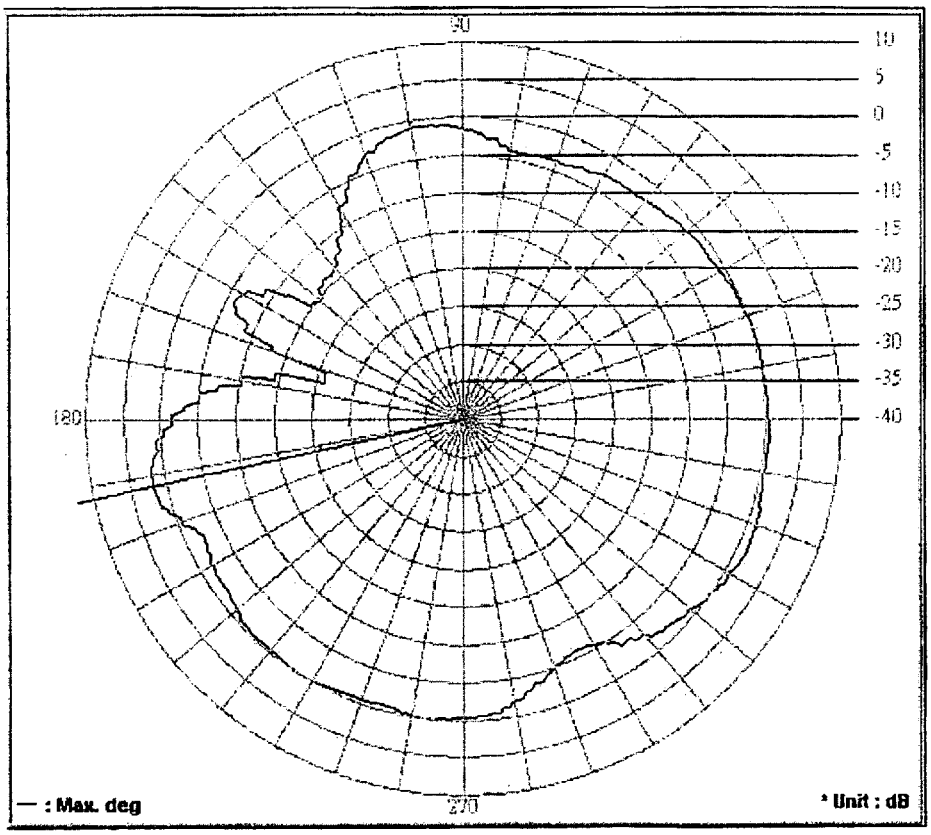
FIG. 5 is a diagram illustrating the lower frequencies of the antenna device of the wireless card device.

The other extension 9 of the antenna device 7 may be provided to receive and transmit the signals of the other frequencies, such as the lower frequency: IEEE 802.11b of such as 2.4 GHz. One example of the radiating field of the lower frequency: IEEE 802.11b of such as 2.4 GHz is shown in FIG. 5.

Similarly, the two extensions 8, 9 of the antenna device 7 may also be provided to receive and transmit the signals of the other frequencies, such as IEEE 802.11e, IEEE 802.11g, etc. or other frequencies. The antenna device 7 may also include three or more extensions 8, 9 provided or attached thereto, to receive and transmit the signals of three or more different frequencies simultaneously.

Accordingly, the wireless card device in accordance with the present invention includes an antenna device for receiving and transmitting signals of two or more different frequencies.

Although this invention has been described with a certain degree of particularity, it is to be understood that the present disclosure has been made by way of example only and that numerous changes in the detailed construction and the combination and arrangement of parts may be resorted to without departing from the spirit and scope of the invention as hereinafter claimed.

I claim:

1. A wireless card device comprising:

a board member, a processor device attached to said board member, a wireless control device attached to said board member, and coupled to said processor device, and an antenna device provided on said board member, and coupled to said wireless control device, said antenna device including an intermediate portion having a trapezoidal base member provided therein, and said base member including a first side portion having a first extension extended therefrom to receive and transmit signals of a frequency, and a second side portion having a second extension extended therefrom to receive and transmit signals of a frequency different from that of said first extension, said first extension and said second extension each including an L-shaped configuration, and said antenna device including a conductor provided around said base member and said first extension and said second extension of said antenna device, to form a hollow space in said antenna device, and said antenna device including a terminal coupled to said conductor and coupled to said wireless control device.

* * * * *